US011309151B2

(12) United States Patent
Koprivsek et al.

(10) Patent No.: US 11,309,151 B2
(45) **Date of Patent: *Apr. 19, 2022**

(54) DIRECT CURRENT ELECTRIC CIRCUIT INTERRUPTING SWITCH ASSEMBLY

(71) Applicant: NELA RAZVOJNI CENTER ZA ELEKTROINDUSTRIJO IN ELEKTRONIKO, D.O.O., Zelezniki (SI)

(72) Inventors: Mitja Koprivsek, Izlake (SI); Brane Lebar, Zagorje ob Savi (SI)

(73) Assignee: ETI Elektroelement, D.O.O.

( * ) Notice: Subject to any disclaimer, the term of this patent is extended or adjusted under 35 U.S.C. 154(b) by 208 days.

This patent is subject to a terminal disclaimer.

(21) Appl. No.: 16/635,803

(22) PCT Filed: Sep. 15, 2017

(86) PCT No.: PCT/SI2017/000023

§ 371 (c)(1),
(2) Date: Jan. 31, 2020

(87) PCT Pub. No.: WO2019/027373

PCT Pub. Date: Feb. 7, 2019

(65) Prior Publication Data

US 2021/0358704 A1 Nov. 18, 2021

(30) Foreign Application Priority Data

Aug. 1, 2017 (SI) ..... P-201700227

(51) Int. Cl.
*H01H 39/00* (2006.01)
*H01H 85/02* (2006.01)
(Continued)

(52) U.S. Cl.
CPC ..... *H01H 39/006* (2013.01); *H01H 9/0066* (2013.01); *H01H 9/10* (2013.01);
(Continued)

(58) Field of Classification Search
CPC ..... H01H 39/006; H01H 9/0066; H01H 9/10; H01H 39/004; H01H 85/0241
See application file for complete search history.

(56) References Cited

U.S. PATENT DOCUMENTS 3,851,219 A * 11/1974 Kozorezov ..... H01H 9/54 361/103
5,990,572 A * 11/1999 Yasukuni ..... H01H 39/006 180/271

(Continued)

FOREIGN PATENT DOCUMENTS

DE 102008044774 A1 10/2009
DE 102009023801 A1 * 2/2010 ..... H01H 85/0241
DE 102016124176 A1 1/2017

OTHER PUBLICATIONS

Winkler, Josef, "Motor vehicle . . . parallel connected to pyrotechnic fuse", Oct. 15, 2009, Audi, Entire Document (Translation of DE102008044774) (Of record, cited in IDS, including Original Document). (Year: 2009).*

(Continued)

*Primary Examiner* — Stephen S Sul
(74) *Attorney, Agent, or Firm* — William B. Nash; Alexander B. Lutzky; Haynes and Boone, LLP

(57) ABSTRACT

A direct current interrupting switch assembly comprising a primary conductor and a secondary conductor integrated with a direct voltage source and a load. The primary conductor of the switch assembly has two branches, the first branch including a fuse with a melting member and the second branch including a pyroswitch with an interrupting member. In a first position, the second branch of the primary (Continued)

conductor is uninterrupted, and the interrupting member is a sufficient distance apart from the secondary conductor. When the interrupting member is moved to a second position, the current in second branch of the primary conductor is interrupted and the interrupting member contacts the secondary conductor of the switch assembly.

4 Claims, 1 Drawing Sheet

(51) Int. Cl.
*H01H 9/00* (2006.01)
*H01H 9/10* (2006.01)

(52) U.S. Cl.
CPC ..... *H01H 39/004* (2013.01); *H01H 85/0241* (2013.01); *H01H 2039/008* (2013.01)

(56) References Cited

U.S. PATENT DOCUMENTS

| | | | | |
|---|---|---|---|---|
| 9,221,343 | B2 | 12/2015 | Tokarz et al. | |
| 11,069,498 | B2 * | 7/2021 | Koprivsek | H01H 39/006 |
| 2013/0154352 | A1 * | 6/2013 | Tokarz | B60L 3/0046 307/9.1 |
| 2016/0225558 | A1 * | 8/2016 | Chatroux | H01H 39/004 |
| 2017/0330714 | A1 * | 11/2017 | von zur Muehlen | H01H 39/00 |
| 2018/0277325 | A1 * | 9/2018 | De Palma | H01H 9/54 |

OTHER PUBLICATIONS

Virgin, Jean-Marc, "Safety device for disconnecting high voltage battery . . . to safety fuse", Feb. 4, 2010, Daimler AG, Entire Document (Translation of DE102009023801). (Year: 2010).*

International Search Report and Written Opinion dated Apr. 12, 2018 issued in related PCT App. No. PCT/SI2017/000023 (9 pages).

* cited by examiner

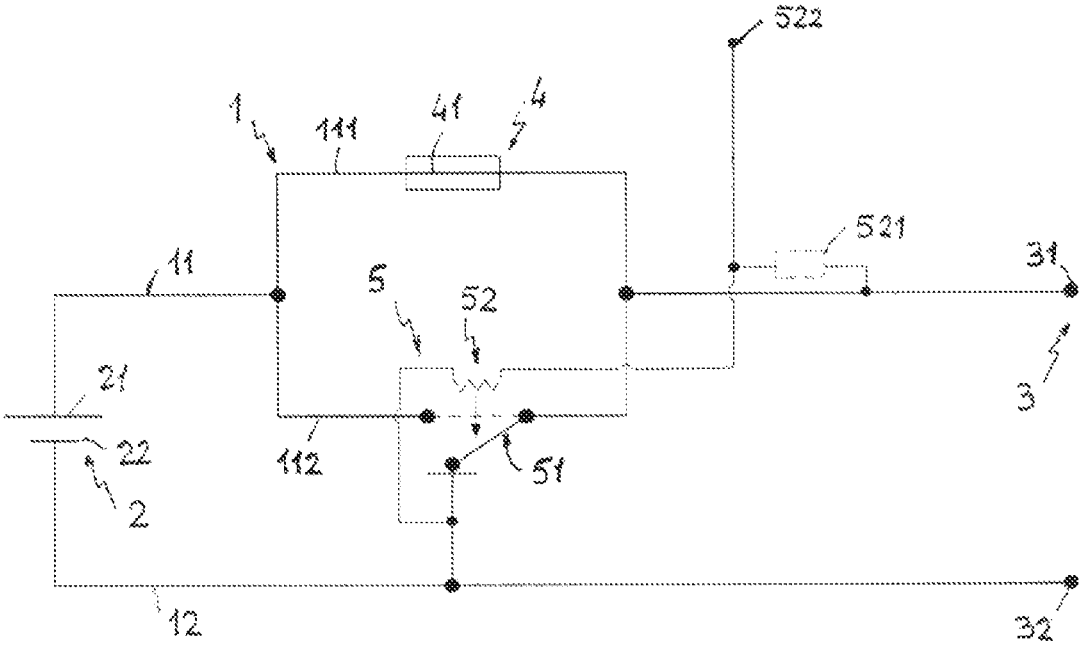
522
1
111
41
4
521
11
31
5
52
21
3
22
112
51
2
12
32

DIRECT CURRENT ELECTRIC CIRCUIT INTERRUPTING SWITCH ASSEMBLY

CROSS-REFERENCE TO RELATED APPLICATIONS

This application is a United States national phase application of co-pending international patent application number PCT/SI2017/000023, filed on Sep. 15, 2017, which claims the benefit of Slovenia Patent Application No. P-201700227, filed Aug. 1, 2017, both of which are hereby incorporated by reference in their entireties.

BACKGROUND

The present disclosure refers to direct current electric circuit interrupting switch assemblies, and more particularly to such switches and switch assemblies activated by means of explosion and initiated based on electric current.

The present disclosure arises from the problem of how to create a small and simple switch assembly, which should on the one hand be capable to withstand long-term repeating induction-related influences as well as dynamic current loadings (i.e. variations of the electric current value within each direct voltage (DC) electric circuit), and which should on the other hand by activation thereof enable prompt interruption of said electric circuit regardless of the value of the electric current and without formation of an electric arc, and which should at the same time ensure a total electric insulation of each electric load(s) from each electric voltage source regardless of the value of the electric current and voltage.

A direct current electric circuit interrupting switch assembly is disclosed in U.S. Pat. No. 9,221,343 B2 (Tesla Motors, Inc.). Such switch assembly includes a direct current electric voltage source, which is electrically connected with each load via primary and secondary conductor. Such assembly is generally suitable for mounting into electric vehicles and serves for interruption of an electric circuit in emergency situations, e.g. by vehicle crash. In practice, the electric voltage source is a battery or a set of mutually interconnected batteries, while said load is an inverter, via which each further electric circuits are supplied by electricity, which serve e.g. for driving vehicles, lighting, heating and air-conditioning, driving of servomotors, or the like. Regarding the discussed solution in U.S. Pat. No. 9,221,343 B2, the secondary electric conductor continuously extends between the negative terminal of the electric energy source and corresponding connecting terminal of the load. The primary electric conductor, which extends between the positive terminal of said direct voltage electric source and the residual connecting terminal of the load is bifurcated and consists of two separate branches, which are in parallel connected with each other, wherein in the first branch an electric fuse with a melting member is integrated, while the second branch includes a pyro switch, which is during regular operation of the electric circuit uninterrupted. Said pyroswitch is furnished with a casing, through which extends an electric conductor, which in this particular case corresponds to said second branch of the primary conductor. In the interior of said casing a blade in form of guillotine is integrated, which consists of an electrically insulating material and which is during regular operation of the electric circuit maintained at certain distance apart from said conductor, however, it is in principle by means of a pyrotechnic actuator also movable towards the conductor, when required. Activation of said actuator occurs based on a signal, which is received by actuator either from a sensor monitoring values of electric current within the electric circuit, or optionally from any other suitable sensors, e.g. from the sensor that serves for activation of inflatable airbags within each vehicle. By activation of such switch, both sections of such interrupted electric conductor are deflected apart from each other and remain in such state split apart from each other and also from any other electrically conductive component.

A pyroswitch is generally commercially available in two embodiments, namely in normally interrupted (NO—normally open) and normally uninterrupted (NC—normally closed). In the discussed solution in U.S. Pat. No. 9,221,343 B2, such switch is during regular operation uninterrupted, but can be interrupted in any need, by which the electric circuit is interrupted. Normally closed switches are much more bulky and are therefore unsuitable for use in electric powered vehicles.

In addition to low electricity power loses such pyroswitch also excels in extremely short reacting time by activation i.e. interruption of each electric circuit, which is performed within approx. 1 ms. On the other hand, such switches are problematic in view of potential variations of properties of chemical reactants contained therein during the time and due to temperature variations, and in addition to that, also in view of voltage overloads and induction-related phenomena. Consequently, during each regular operation of the switch assembly both conductors are connected on the one hand with the electric voltage source, and on the other hand with each electric load, by which the electric current due to relatively high resistance of the melting member within the electric fuse the electric current is merely conducted through those branch, in which said pyroswitch is integrated. In such manner, in particular by using such switch assemblies in the electric vehicles, deficiencies related to electric fuses with melting member, which are unable to withstand durable dynamic current overloads, are minimized. Namely, during utilization of electric fuses in electric vehicles, it has been found that physical properties of the material of the melting member may, due to long-term varying the values of current conducted there-through, be changed in such extent that any further reactions of the melting member during the forthcoming current loadings becomes relatively unpredictable and unreliable.

When said switch assembly according to U.S. Pat. No. 9,221,343 B2 is exposed to such current overloading of the electric circuit, in which it is integrated, it should react by interrupting the primary electric current on the basis of a received signal, by which first of all said pyroswitch is activated, which results in interruption of current within the corresponding branch, upon which the current may still be conducted through the other branch i.e. through the melting member of the electric fuse, which then starts to melt, by which the electric circuit throughout the switch assembly i.e. between the electric voltage source and each electric load becomes completely interrupted. In case of substantial current overloads, in which the current exceeds a multiple value of a nominal current limit value in the electric fuse, interruption of the melting member is performed relatively quickly, which in practice means within approximately 20 ms. However, when using such switch assembly in vehicles, the current overloads in particular during a smooth drive are usually not so high. In such case, by vehicle crash said actuator should normally trigger the pyroswitch, by which the belonging branch of the primary conductor in the electric circuit is interrupted, upon which the current is re-directed through the residual branch of said conductor. When the current overload is just slightly above the nominal value of the electric fuse, then melting of said melting member may take several minutes or even more than one hour, which is in any crash situation quite unacceptable and dangerous due to the risk of establishing short circuits and/or electric arc. In addition to that, even in the case of quick and successful interruption of the primary conductor in the electric circuit between the direct voltage electric circuit and each electric load, the secondary conductor still remains uninterrupted and connected with both with electric voltage source and the electric load. In particular in vehicles this deficiency may lead to problems, since said electric load is in the one hand connected with said electric voltage source, and on the other hand also with various electric circuits, where some of these may also contain capacitors, in which electric capacity still remains stored and which may represent additional electric voltage sources, which persist active despite to interruption of the primary electric conductor of such switch assembly. Such "hidden" electric voltage sources may also be extremely dangerous in said vehicle crash situations.

Moreover, a parallel circuit comprising a pyrotechnic fuse as well as another fuse is disclosed in DE 10 2008 044 774 A1. Still further, an electric interrupting switch for interrupting at high currents and high voltages is disclosed in DE 10 2016 124 176 A1.

BRIEF DESCRIPTION OF THE DRAWING

FIG. 1 is a schematic drawing of an embodiment of the switch assembly of the present disclosure.

DETAILED DESCRIPTION

The present disclosure refers to a direct current electric circuit interrupting switch assembly, which is upon establishing of electric connection via primary electric conductor and secondary electric conductor suitable for integration between a direct voltage electric source and at least one load, so that by means of said conductors of the switch assembly a primary terminal of said electric source is electrically connectable with a primary terminal of each electric load, and a secondary terminal of said electric source is electrically connectable with a secondary terminal of each electric load. Said primary electric conductor of the switch assembly comprises two branches, which are in parallel connected with each other, wherein the first branch includes an electric fuse with a melting member, and the second branch includes a pyroswitch with an interrupting member, which is capable to interrupt said second branch of the primary electric conductor extending through said pyroswitch, as well as with an actuator, which is capable to ensure appropriate movement of said interrupting member due to interruption of said second branch of the primary electric conductor by means of explosion of at least one chemical reactant contained therein by means of an electric impulse received either from a sensor for monitoring of electric current value in each electric circuit, or from any other sensor suitable for monitoring at least one physical characteristic available in each desired location in any apparatus in which said switch assembly is integrated.

The previously mentioned technical problem is solved by means of arrangement, according to which said pyroswitch comprises such an interrupting member, which is within said pyroswitch displaceable from its first i.e. initial position, in which by means of it said second branch of the primary electric conductor is uninterrupted and in which said interrupting member is held at a sufficient distance apart from the secondary electric conductor, into its second i.e. shifted position, in which the electric circuit throughout the second branch of the primary electric conductor is interrupted and the interrupting member is held in an electric conductive contact with the secondary conductor of the switch assembly.

The present disclosure further provides that said interrupting member is a mechanically interruptible and from its initial position to its second position displaceable section of the second branch of the primary electric conductor.

A switch assembly according to the present disclosure is still further characterized in that said interrupting member in its second i.e. shifted position, in which the electric circuit through the second branch of the primary electric conductor is interrupted, is held in electric conductive contact with the second electric conductor of the switch assembly, and consequently also in electric contact with each load and also with the secondary terminal of each direct voltage electric source.

The present disclosure will be explained in some more detail by means of an embodiment, which is schematically presented in FIG. 1.

Direct current electric circuit interrupting switch assembly 1 can establish an electric connection via primary electric conductor 11 and secondary electric conductor 12 integrated between a direct voltage electric source 2 and at least one load 3. In this, by means of said conductors 11, 12 of the switch assembly 1 a primary terminal 21 of said electric source 2 is electrically connectable with a primary terminal 31 of each electric load 3, and a secondary terminal 22 of said electric source 2 is electrically connectable with a secondary terminal 32 of each electric load 3.

Said primary electric conductor 11 of the switch assembly 1 comprises two branches 111, 112, which are parallel connected with each other, wherein the first branch 111 includes an electric fuse 4 with a melting member 41 and the second branch 112 includes a pyroswitch 5 with an interrupting member 51, which is capable to interrupt said second branch 112 of the primary electric conductor 11 extending through said pyroswitch 5, as well as with an actuator 52, which is capable to ensure appropriate movement of said interrupting member 51 due to interruption of said second branch 112 of the primary electric conductor 11 by means of explosion of at least one chemical reactant contained therein by means of a received electric impulse. Said actuator 52 in each critical situation, e.g. by a car crash, receives an impulse either from a sensor 521, which may be suitable for monitoring of electric current value in either one or both of the primary electric conductor 11 or secondary electric conductor 12, or from any other sensor 522, which may be suitable for monitoring at least one physical characteristic and available in each desired location in any apparatus in which said switch assembly 1 is integrated.

In the context of resolving the previously mentioned technical problem, said switch assembly according has been modified in accordance with the present disclosure and is furnished with such pyroswitch 5, which comprises an interrupting member 51, which is within said pyroswitch 5 displaceable from its first i.e. origin position, in which by means of it said second branch 112 of the primary electric conductor 11 is uninterrupted and in which said interrupting member 51 is held at a sufficient distance apart from the secondary electric conductor 12, into its second i.e. shifted position, in which the electric circuit throughout the second branch 112 of the primary electric conductor 11 is interrupted and the interrupting member 51 is held in an electric conductive contact with the secondary conductor 12 of the switch assembly 1.

Said interrupting member 51 can be a mechanically interruptible and from its initial position to its second position displaceable section of the second branch 112 of the primary electric conductor 11.

Consequently, said interrupting member 51 is in its second i.e. shifted position, in which the electric circuit through the second branch 112 of the primary electric conductor 11 is interrupted, held in electric conductive contact with the second electric conductor 12 of the switch assembly 1, and herewith consequently also in electric contact with each load 3 and also with the secondary terminal 22 of the direct voltage electric source 2.

Thanks to such surprisingly simple measures, the previously mentioned technical problem is completely resolved. The switch assembly 1 is no doubt simple and is despite to introduction of appropriate pyroswitch 5 not bulky in view of each required space. Thanks to arrangement of said pyroswitch 5 and the electric fuse 4 with its melting member 4 into two separate branches 111, 112 of primary electric conductor 11 such switch assembly 1 is capable to withstand temperature variations of temperature variations and is moreover able to deal with inductivity variations as well as dynamic current intensity, i.e. frequently changing of electric current values within each particular direct voltage (DC) electric circuit. On the other hand, said switch assembly enables a prompt interruption of said direct voltage electric circuit on the basis of activation of the actuator 52, e.g. in situation of electrically driven vehicle crash, regardless to each electric voltage and actual value of the electric current, and in particular without establishing an electric arc, by which also each disposable electric load(s) become(s) completely insulated with regard to each disposable direct voltage electric source. Thanks to said displacement of the interrupting member 51 from its origin i.e. uninterrupted position into its shifted position in contact with the secondary conductor 12 in each direct voltage circuit, via said switch assembly 1 and each load 3 an additional electric circuit is established, which is completely separated from the electric voltage source 2, and although any additional electric sources remain hidden within such newly established circuit, such sources cannot be brought in contact with the electric source 2.

What is claimed is:

1. A direct current electric circuit interrupting switch assembly for establishing an electric connection comprising:

a primary electric conductor and a secondary electric conductor adapted for integration between a direct voltage electric source and at least one load;

wherein by means of said primary and secondary electric conductors, a primary terminal of said electric source is electrically connectable with a primary terminal of the at least one load, and a secondary terminal of said electric source is electrically connectable with a secondary terminal of the at least one load;

wherein the primary electric conductor of the switch assembly comprises a first branch and a second branch, which are connected in parallel with each other, the first branch including an electric fuse with a melting member, and the second branch including a pyroswitch with an interrupting member, which is capable of interrupting the second branch of the primary electric conductor extending through the pyroswitch, as well as with an actuator, which is capable to ensure movement of the interrupting member due to interruption of the second branch of the primary electric conductor by means of explosion of at least one chemical reactant contained therein by means of an electric signal received from either a first sensor for monitoring of electric current in the primary electric conductor or a second sensor for monitoring at least one physical characteristic in an apparatus in which the switch assembly is integrated; and wherein said pyroswitch comprises said interrupting member, which is within said pyroswitch and is displaceable from a first position, in which said second branch of the primary electric conductor is uninterrupted and in which said interrupting member is held at a sufficient distance apart from the secondary electric conductor, into a second position, in which the electric circuit in the second branch of the primary electric conductor is interrupted and the interrupting member is held in an electric conductive contact with the secondary electric conductor of the switch assembly.

2. The switch assembly according to claim 1, wherein said interrupting member is mechanically actuated from the first position to the second position within the second branch of the primary electric conductor.

3. The switch assembly according to claim 2, wherein said interrupting member in said second position, in which the electric circuit through the second branch of the primary electric conductor is interrupted, is held in said electric conductive contact with the second electric conductor of the switch assembly, and consequently also in electric contact with said at least one load and with the secondary terminal of the direct voltage electric source.

4. The switch assembly according to claim 1, wherein said interrupting member in said second position, in which the electric circuit through the second branch of the primary electric conductor is interrupted, is held in said electric conductive contact with the second electric conductor of the switch assembly, and consequently also in electric contact with said at least one load and with the secondary terminal of the direct voltage electric source.

* * * * *